US009593658B2

(12) United States Patent
Proebstle et al.

(10) Patent No.: US 9,593,658 B2
(45) Date of Patent: Mar. 14, 2017

(54) HIGH-VOLTAGE PINION STARTER

(71) Applicant: Bayerische Motoren Werke Aktiengesellschaft, Munich (DE)

(72) Inventors: Hartmut Proebstle, Wuerzburg (DE); Sherif Mahmoud, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 817 days.

(21) Appl. No.: 13/860,062

(22) Filed: Apr. 10, 2013

(65) Prior Publication Data

US 2013/0269645 A1 Oct. 17, 2013

(30) Foreign Application Priority Data

Apr. 11, 2012 (DE) ..... 10 2012 205 826

(51) Int. Cl.
*F02N 11/08* (2006.01)

(52) U.S. Cl.
CPC ..... *F02N 11/087* (2013.01); *F02N 11/0866* (2013.01); *F02N 2011/0896* (2013.01)

(58) Field of Classification Search
CPC ..... F02N 11/087; F02N 15/067; F02N 2011/0892; F02N 11/0814; F02N 11/0851; F02N 11/0866; F02N 2011/0896; H01H 51/065
USPC ..... 123/179.1–179.4
See application file for complete search history.

(56) References Cited

U.S. PATENT DOCUMENTS

| | | | | |
|---|---|---|---|---|
| 4,917,410 | A * | 4/1990 | Cummins et al. | 290/38 R |
| 6,608,394 | B2 | 8/2003 | Osada et al. | |
| 8,299,639 | B2 * | 10/2012 | Usami et al. | 290/38 R |
| 2002/0070555 | A1 * | 6/2002 | Osada et al. | 290/31 |
| 2010/0299053 | A1 * | 11/2010 | Okumoto et al. | 701/113 |
| 2011/0155085 | A1 * | 6/2011 | Hirano et al. | 123/179.3 |
| 2011/0232597 | A1 * | 9/2011 | Benchetrite et al. | 123/179.4 |
| 2011/0259659 | A1 * | 10/2011 | Calley | H02K 1/246 180/65.51 |
| 2012/0260878 | A1 | 10/2012 | Kitano et al. | |

FOREIGN PATENT DOCUMENTS

| | | | |
|---|---|---|---|
| DE | 196 24 117 | A1 | 12/1997 |
| DE | 601 04 635 | T2 | 8/2005 |
| DE | 10 2009 057 263 | A1 | 6/2011 |
| DE | 11 2010 005 184 | T5 | 10/2012 |

OTHER PUBLICATIONS

German-language Search Report dated Feb. 13, 2013 with partial English translation (Ten (10) pages).

* cited by examiner

*Primary Examiner* — Sizo Vilakazi
(74) *Attorney, Agent, or Firm* — Crowell & Moring LLP

(57) ABSTRACT

A vehicle is provided with a pinion starter for an internal-combustion engine, which vehicle includes a low-voltage onboard power supply system and a high-voltage onboard power supply system. The pinion starter has an electric motor and a solenoid switch, wherein the electric motor is constructed as a polyphase machine. The polyphase machine can be supplied with electric power from the high-voltage onboard power supply system, and the solenoid switch can be electrically supplied by the low-voltage onboard power supply system.

21 Claims, 1 Drawing Sheet

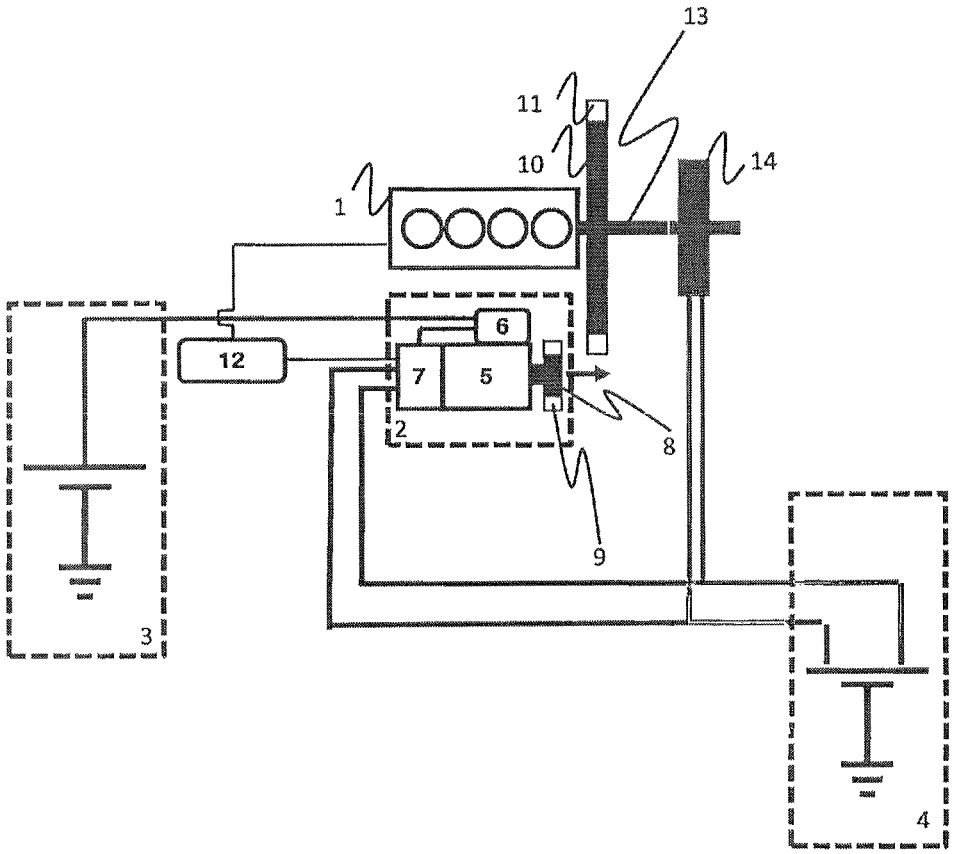
13
11
10
14
1
6
12
7
5
2
8
9
3
4

HIGH-VOLTAGE PINION STARTER

CROSS REFERENCE TO RELATED APPLICATIONS

This application claims priority under 35 U.S.C. §119 from German Patent Application No. DE 10 2012 205 826.5, filed Apr. 11, 2012, the entire disclosure of which is herein expressly incorporated by reference.

BACKGROUND AND SUMMARY OF THE INVENTION

The invention relates to vehicle having a pinion starter for an internal-combustion engine, which includes a low-voltage onboard power supply system and a high-voltage onboard power supply system, and wherein the pinion starter has an electric motor and a solenoid switch.

In the case of vehicles having an automatic motor start/stop function in comparison to a conventional motor vehicle where only cold starts are carried out at the start of a drive, the number of starting operations of the internal-combustion engine has clearly increased. This applies particularly to hybrid vehicles, where, after an automatic stop of the internal-combustion engine and during an electric drive, the internal-combustion engine is additionally started.

According to the state of the art, starting systems for internal-combustion engines of hybrid vehicles are known which include a high-voltage starter; see, for example, German Patent document DE 10 2009 057 263 A1.

It is an object of the invention to provide an improved vehicle having a pinion starter for an internal-combustion engine, which includes a low-voltage onboard power supply system and a high-voltage onboard power supply system, and wherein the pinion starter has an electric motor and a solenoid switch.

This and other objects are achieved according to the invention by a vehicle having a pinion starter for an internal-combustion engine which includes a low-voltage onboard power supply system and a high-voltage onboard power supply system and wherein the pinion starter has an electric motor and a solenoid switch. The electric motor is constructed as a polyphase machine, which can be supplied with electric power from the high-voltage onboard power supply system, and the solenoid switch can be electrically powered by the low-voltage onboard power supply system.

This means that the pinion starter can be integrated in a vehicle having a low-voltage onboard power supply system and a high-voltage onboard power supply system such that the electric motor is designed to be high-voltage-compatible and is supplied with electric power from the high-voltage onboard power supply system, and the solenoid switch is electrically powered by the low-voltage onboard power supply system.

According to a further embodiment of the invention, the pinion starter includes a power electronics unit which controls the polyphase machine and the solenoid switch, and which can be electrically supplied by the high-voltage onboard power supply system and inverts electric power from the high-voltage onboard power supply system.

This means that the pinion starter has a power electronics unit which bidirectionally exchanges automatic control and control signals with the polyphase machine. The power electronics system automatically controls the polyphase machine and supplies the polyphase machine with inverted electric power from the high-voltage onboard power supply system.

In addition, it is advantageous for the motor vehicle to have a control device, and for the control device to bidirectionally communicate with the power electronics unit. The power electronics unit or the control device unidirectionally exchanges control signals with the solenoid switch and controls the solenoid switch. Accordingly, the control device can transmit control parameters and automatic control parameters for the control of the polyphase machine to the power electronics unit, and can transmit control parameters for the solenoid switch to the solenoid switch or the power electronics unit.

According to another embodiment of the invention, the vehicle is constructed as a hybrid vehicle, and the pinion starter can carry out cold starts, warm starts and reflex starts. A cold start is a start at the beginning of a drive. A warm start is an additional start of the internal-combustion engine during the actual drive, for example, after an automatic motor stop at a red traffic light or an additional start of the internal-combustion engine during a purely electrical acceleration. A reflex start is a start of the internal-combustion engine when the internal-combustion engine is coming to a stop, i.e. is still rotating.

Furthermore, it is advantageous for the control device to perform an automatic rotational speed detection of the internal-combustion engine and an automatic rotational speed detection of the polyphase machine, and for the power electronics unit to engage the pinion in a motor gear ring when the rotational speed of the polyphase machine is synchronized with the rotational speed of the internal-combustion engine.

In the case of a reflex start, it is also contemplated for the rotational speed of the motor that is coming to a stop and therefore the rotational speed of the polyphase machine and thus of the starter pinion to be monitored, and, at a rotational speed synchronous with the rotational speed of the motor ring gear, for the pinion to engage in the motor ring gear.

In addition, the power electronics unit is constructed with a galvanic isolation. This is particularly advantageous because the power electronics unit is electrically connected with the high-voltage onboard power supply system as well as with the low-voltage onboard power supply system. The galvanic isolation has the result that low-voltage onboard power supply system will be free of potentials from the high-voltage onboard power supply system.

According to a particularly preferred embodiment of the invention, the power electronics unit and the polyphase machine are constructed to be air-cooled.

The polyphase machine is preferably constructed as an asynchronous machine. The power electronics unit and the polyphase machine can then be further developed in a particularly cost-effective and robust manner.

The invention is based on the following considerations. In the case of hybrid vehicles (plug-in hybrid vehicles or vehicles having a motor stop/start function), a starting of the switched-off internal-combustion engine can be carried out during a driving operation of the vehicle. Such a start is called an additional start and is carried out by way of a high-voltage driving machine or a pinion starter from a separate 12-volt additional-start onboard power supply system. It is disadvantageous that a separate 12-V additional-start onboard power supply system, in addition to a 12-V basic onboard power supply system, as a rule, requires a separate additional-start accumulator and a coupling element between the 12-V basic onboard power supply system and the 12-V additional-start power supply system for recharging the additional-start accumulator.

Depending on the machine concept of the driving machine, an additional start by way of a high-voltage driving machine requires a high torque margin in the driving machine for starting power to be applied parallel to the electric driving. This torque to be used as the margin is not available for electric driving.

Therefore, according to the invention, a high-voltage pinion starter is integrated as a starting system for cold, warm and reflex starting operations in the case of hybrid vehicles. The advantage of a high-voltage pinion starter consists of the geometric and electric similarity to a conventional pinion starter. This concerns the geometric design and the interfaces of a high-voltage pinion starter. A high-voltage pinion starter with a high-voltage-compatible driving unit has a starter pinion behavior with a 12-V solenoid switch and an overrunning clutch construction similar to a conventional pinion starter. In addition, the high-voltage pinion starter can be integrated in a space that is comparable to that of a conventional pinion starter. The motor core with the primary winding and the secondary winding has a high-voltage compatible construction while taking into account touch voltage defaults for high-voltage systems.

A high-voltage pinion starter offers several advantages: while utilizing spaces known for conventional internal-combustion engine vehicles, in the case of hybrid vehicles, additional-start demands can be converted without enabling a high-voltage driving machine for additional starts and without integrating an additional onboard power supply system with a booster accumulator and a DC converter in the vehicle.

Other objects, advantages and novel features of the present invention will become apparent from the following detailed description of one or more preferred embodiments when considered in conjunction with the accompanying drawing.

BRIEF DESCRIPTION OF THE DRAWING

FIG. 1 is a schematic view of a high-voltage pinion starter in a vehicle according to an embodiment of the invention.

DETAILED DESCRIPTION OF THE DRAWING

FIG. 1 illustrates a vehicle having an internal-combustion engine (1), a low-voltage onboard power supply system (3) and a high-voltage onboard power supply system (4). The vehicle is a hybrid vehicle and has an electric drive machine (14), which can be supplied with electric power from the high-voltage onboard power supply system (4), in the transmission line. A pinion starter (2) is set up for starting the internal-combustion engine (1). The pinion starter (2) corresponds to a conventional 12-V pinion starter which is known to the person skilled in the art, but, here it is skillfully modified and skillfully integrated in the vehicle. The pinion starter (2) has a starter pinion (8) with pinion teeth (9) which, in an engaged condition, mesh with gear teeth (11) of a gear ring (10) of the internal-combustion engine. The engaging of the starter pinion takes place by a solenoid switch (6). The solenoid switch (6) is supplied by the low-voltage onboard power supply system (3) of the vehicle. In the engaged condition, an electric machine (5) of the pinion starter (2) starts to rotate the internal-combustion engine (1) by way of the gear ring (10).

The electric machine (5) of the pinion starter is constructed as an asynchronous polyphase machine with a cage rotor. The polyphase machine is supplied by way of the high-voltage onboard power supply system (4) of the vehicle. A power electronics system (7), which is a component of the pinion starter (2), is connected between the high-voltage onboard power supply system (4) and the polyphase machine (5). The power electronics system (7) supplies the polyphase machine with inverted current from the high-voltage onboard power supply system. The pinion starter is therefore also called a high-voltage pinion starter. In particular, the power electronics system (7) detects the rotational speed of the rotor by way of an engine speed sensor. In addition to the polyphase machine, the power electronics system controls the solenoid switch (6). The electrical supply of the solenoid switch, i.e. the energy required, for example, for the building-up of a magnetic field in an exciting coil, is provided by the low-voltage onboard power supply system (3). For this purpose, the solenoid switch is wired from the power electronics unit by way of a power switch, such as a MOSFET, to the low-voltage onboard power supply system.

The power electronics system communicates bidirectionally with a control device (12) of the vehicle. The control device transmits particularly the rotational speed of the engine (1) or the rotational speed of the gear teeth (11) to the power electronics system (2), as an input signal. As a function of the rotational speed of the pinion (8), and thus of the rotational speed of the pinion teeth (9), the power electronics system controls the solenoid switch (6). In the time period during which the rotational speed of the pinion teeth is essentially synchronous, i.e. identical with the rotational speed of the gear teeth, the power electronics system will transmit an engage signal to the solenoid switch.

When the pinion is engaged, the power electronics system triggers the actual breaking-away of the starter.

The polyphase machine (5) transmits the torque necessary for the start of the internal-combustion engine (1) to the gear ring (10). After the start of the engine, the internal-combustion engine will overtake the cage rotor motor. In this phase, the bearing of the starter pinion with an overrunning clutch causes an uncoupling of the starter pinion from the starter motor. This superelevation of the rotational speed of the internal-combustion engine, which can be detected by the power electronics system, triggers the engaging of the starter pinion by the solenoid switch.

This has the special advantage that, in the case of a hybrid vehicle, a restarting can take place also when the internal-combustion engine is coming to a stop, for example, in a rolling phase of the vehicle. A stopping of the gear ring is not necessary so that the restart can take place immediately upon a starting prompt. Such a start is therefore also called a reflex start. Furthermore, the reflex start takes place on the basis of the synchronicity of the rotational speeds without tooth-tooth collisions between the pinion teeth and the gear ring teeth. Such a reflex start can be carried out almost noiselessly and without jerking. A reflex start can therefore be carried out so that it is hardly noticed by an occupant of the vehicle and therefore in a very comfortable manner. This can additionally be assisted by a helical gearing of the teeth.

The engaging of the starter pinion for a cold start and for a warm start takes place in the case of the high-voltage starter as in the case of a conventional pinion starter. This means that, automatically controlled by the power electronics system of the high-voltage pinion starter, in the case of a reflex start, first the polyphase machine is rotated and then the pinion is engaged, and, in the case of a warm start, the pinion is first engaged, and subsequently, the rotation of the polyphase machine is started.

The power electronics system of the high-voltage pinion starter, in addition, has a galvanic isolation. This means that the power electronics system ensures an electric uncoupling of the high-voltage potential of the high-voltage onboard power supply system from the low-voltage potential of the low-voltage onboard power supply system.

The high-voltage pinion starter has the advantage that, in the case of a hybrid vehicle, cold starts, warm starts and reflex starts can be carried out by a single starting system. In the hybrid vehicle, the spaces typically used for a conventional pinion starter can be utilized by the high-voltage pinion starter. In addition, the drive of the polyphase motor takes place from the high-voltage onboard power supply system. It is thereby ensured that the high electric power necessary for a start of the internal-combustion engine is provided by the high-voltage onboard power supply system. The electric power for switching the solenoid switch, which is considerably lower, is provided by the low-voltage onboard power supply system. This means that, during a start, the voltage drop, typically taking place in a vehicle onboard power supply system because of the power demand of the starter, will be absent in the low-voltage onboard power supply system. This results in a high voltage-related stability in the low-voltage onboard power supply system, so that particularly low-voltage-critical consuming devices in the low-voltage onboard power supply system can be electrically supplied in a reliable manner during a start.

The galvanic isolation of the high-voltage potential from the low-voltage potential by way of the high-voltage pinion starter is particularly advantageous. The supply to the solenoid switch by the low-voltage onboard power supply system and the galvanic isolation of the power electronics system ensure that the high-voltage potential, by which the cage rotor motor can be driven, cannot "penetrate" to the low-voltage onboard power supply system.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A vehicle having an internal-combustion engine, comprising:

a pinion starter comprising an electric motor and a solenoid switch, the pinion starter being operatively configured to start the internal-combustion engine;

a low-voltage onboard power supply system;

a high-voltage onboard power supply system, wherein:

the electric motor is a polyphase machine, the polyphase machine is supplyable with electric power from the high-voltage onboard power supply system, the solenoid switch is supplyable with electric power from the low-voltage onboard power supply system, and the high-voltage onboard power supply system is galvanically isolated from the low-voltage onboard power supply system.

2. The vehicle according to claim 1, wherein the pinion starter comprises a power electronics unit, the power electronics unit being operatively configured to control the polyphase machine.

3. The vehicle according to claim 2, wherein:

the high-voltage onboard power supply system supplies the power electronics unit with electric power, and the power electronics unit inverts the electric power from the high-voltage onboard power supply system.

4. The vehicle according to claim 2, further comprising:

a control device operatively configured to communicate with the power electronics unit, wherein:

the power electronics unit and the control device are directly connected to the solenoid switch.

5. The vehicle according to claim 3, further comprising:

a control device operatively configured to communicate with the power electronics unit, wherein:

the power electronics unit and the control device are directly connected to the solenoid switch.

6. The vehicle according to claim 4, wherein:

the control device is operatively configured to determine when a rotational speed of the internal-combustion engine and a rotational speed of the polyphase machine are synchronized, and the power electronics unit signals the solenoid switch to engage a pinion of the pinion starter in a motor gear ring when the rotational speed of the polyphase machine is synchronized with the rotational speed of the internal-combustion engine.

7. The vehicle according to claim 5, wherein:

the control device is operatively configured to determine when a rotational speed of the internal-combustion engine and a rotational speed of the polyphase machine are synchronized, and the power electronics unit signals the solenoid switch to engage a pinion of the pinion starter in a motor gear ring when the rotational speed of the polyphase machine is synchronized with the rotational speed of the internal-combustion engine.

8. The vehicle according to claim 2, wherein the power electronics unit is constructed with a galvanic isolation.

9. The vehicle according to claim 3, wherein the power electronics unit is constructed with a galvanic isolation.

10. The vehicle according to claim 4, wherein the power electronics unit is constructed with a galvanic isolation.

11. The vehicle according to claim 6, wherein the power electronics unit is constructed with a galvanic isolation.

12. The vehicle according to claim 2, wherein the power electronics unit and the polyphase machine are air-cooled.

13. The vehicle according to claim 1, wherein the polyphase machine is an asynchronous polyphase machine.

14. The vehicle according to claim 1, wherein the vehicle is a hybrid vehicle, cold starts, warm starts and reflex starts of the internal-combustion engine of the hybrid vehicle being carried out by the pinion starter.

15. A pinion starter for an internal-combustion engine of a vehicle having a low-voltage onboard power supply system and a high-voltage onboard power supply system, comprising:

an electric motor operatively configured as a polyphase machine;

a solenoid switch operatively configured to engage and disengage a pinion of the pinion starter, wherein:

the polyphase machine is supplyable with electric power from the high-voltage onboard power supply system, the solenoid switch is supplyable with electric power from the low-voltage onboard power supply system, and the high-voltage onboard power supply system is galvanically isolated from the low-voltage onboard power supply system.

16. The pinion starter according to claim 15, further comprising:

a power electronics unit operatively configured to control the polyphase machine.

17. The pinion starter according to claim 16, wherein the power electronics unit is supplyable with electric power from the high-voltage onboard power supply system, and inverts said electric power.

18. The pinion starter according to claim 16, further comprising:

a control device operatively configured to communicate with the power electronics unit, wherein the power electronics unit and the control device are directly connected to the solenoid switch.

19. The pinion starter according to claim 18, wherein:

the control device is operatively configured to determine when a rotational speed of the internal-combustion engine and a rotational speed of the polyphase machine are synchronized, and the power electronics unit is operatively configured to signal the solenoid switch to engage the pinion of the pinion starter in a motor gear ring of the internal-combustion engine when the rotational speed of the polyphase machine is synchronized with the rotational speed of the internal-combustion engine.

20. A vehicle having an internal-combustion engine, comprising:

a pinion starter comprising an electric motor and a solenoid switch, the pinion starter being operatively configured to start the internal-combustion engine;

a low-voltage onboard power supply system;

a power electronics system: and a high-voltage onboard power supply system, wherein:

the electric motor is a polyphase machine, the low-voltage onboard power supply system is directly connected to the solenoid switch, the high-voltage onboard power supply system is directly connected to the power electronics system so that the power electronics system supplies the polyphase machine with an inverted current received from the high voltage onboard power supply system, and the solenoid: i) is directly connected to the low-voltage onboard power supplysystem and to the power electronics system, and ii) is electrically uncoupled from the high-voltage onboard power supply system.

21. The vehicle according to claim 1, further comprising:

a power electronics system; and a control device that transmits a rotational speed of the internal-combustion engine and a rotational speed of gear teeth to the power electronics system, wherein the low-voltage onboard power supply system is directly connected to the control device.

* * * * *